US010254686B2

(12) United States Patent
Minagawa et al.

(10) Patent No.: US 10,254,686 B2
(45) Date of Patent: Apr. 9, 2019

(54) FIXING APPARATUS THE FIXES AN IMAGE ON RECORDING MATERIAL AND PERFORMS MOTOR CONTROL AFTER FIXING THE IMAGE

(71) Applicant: CANON KABUSHIKI KAISHA, Tokyo (JP)

(72) Inventors: Taisuke Minagawa, Suntou-gun (JP); Mahito Yoshioka, Numazu (JP); Satoru Taniguchi, Mishima (JP); Takashi Honke, Mishima (JP); Hirohiko Aiba, Suntou-gun (JP); Masaki Hirose, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/384,981

(22) Filed: Dec. 20, 2016

(65) Prior Publication Data

US 2017/0185013 A1 Jun. 29, 2017

(30) Foreign Application Priority Data

Dec. 25, 2015 (JP) ..... 2015-254912

(51) Int. Cl.
*G03G 15/20* (2006.01)

(52) U.S. Cl.
CPC ..... *G03G 15/2028* (2013.01); *G03G 15/2039* (2013.01); *G03G 15/205* (2013.01); *G03G 2215/2035* (2013.01); *G03G 2215/2045* (2013.01); *G03G 2221/1657* (2013.01)

(58) Field of Classification Search
CPC ..... G03G 15/2028; G03G 15/2039; G03G 2221/1657; G03G 2215/2035; G03G 15/205; G03G 2215/0245
See application file for complete search history.

(56) References Cited

U.S. PATENT DOCUMENTS 6,748,192 B2 6/2004 Izawa et al.
7,539,430 B2 5/2009 Ishikuro et al.
8,036,560 B2 10/2011 Otsuka
(Continued)

FOREIGN PATENT DOCUMENTS

JP S63313182 A 12/1988
JP H0444075 A 2/1992
(Continued)

*Primary Examiner* — David M. Gray
*Assistant Examiner* — Laura Roth
(74) *Attorney, Agent, or Firm* — Rossi, Kimms & McDowell LLP

(57) ABSTRACT

The fixing apparatus includes a cylindrical heating film, a nip portion forming member, a roller; a motor, a control unit, and an acquisition unit. The apparatus executes a fixing process of conveying and heating the recording material carrying the toner image to fix the toner image to the recording material at the nip portion. The apparatus is further configured to execute a first mode of stopping the supply of power to the motor just after the end of the fixing process and a second mode of stopping the supply of power to the motor after a low-speed rotation period for rotating the motor at a rotational speed set lower than the target rotational speed during the fixing process after the end of the fixing process, and to select one of the first and second modes.

19 Claims, 9 Drawing Sheets

(56) References Cited

U.S. PATENT DOCUMENTS

| | | | | |
|---|---|---|---|---|
| 2012/0163848 | A1* | 6/2012 | Okano | G03G 15/205 399/69 |
| 2014/0205340 | A1* | 7/2014 | Yamaguchi | G03G 15/602 399/396 |
| 2016/0116875 | A1* | 4/2016 | Hazeyama | G03G 15/2085 399/67 |

FOREIGN PATENT DOCUMENTS

| | | | |
|---|---|---|---|
| JP | 2003045615 | A | 2/2003 |
| JP | 2007334204 | A | 12/2007 |
| JP | 2010002536 | A | 1/2010 |
| JP | 2015055709 | A | 3/2015 |

* cited by examiner

FIXING APPARATUS THE FIXES AN IMAGE ON RECORDING MATERIAL AND PERFORMS MOTOR CONTROL AFTER FIXING THE IMAGE

BACKGROUND OF THE INVENTION

Field of the Invention

The present embodiments relate to an image heating apparatus mounted on an image forming apparatus, such as an electrophotographic copying machine and an electrophotographic printer, and an image forming apparatus including the image heating apparatus.

Description of the Related Art

In an image forming apparatus, such as an electrophotographic copying machine and an electrophotographic printer, a fixing apparatus of a heat roller system is conventionally widely used as an image heating apparatus (fixing apparatus) configured to heat, pressurize and fix an unfixed toner image carried on a recording material to the recording material. In recent years, a fixing apparatus of a film heating system is also implemented from the viewpoint of quick start or energy saving.

The fixing apparatus of the film heating system is disclosed in Japanese Patent Application Laid-Open No. S63-313182 and Japanese Patent Application Laid-Open No. H04-44075. The fixing apparatus of the film heating system includes: a heater as a heating body; a fixing film as a flexible rotating body coming into contact with the heater to generate heat and rotate; and a pressure roller as a pressure member forming a fixing nip portion along with the heater through the fixing film.

The recording material carrying the unfixed toner image is introduced between the fixing film and the pressure roller at the fixing nip portion, and the recording material is sandwiched and conveyed along with the fixing film. In this way, the pressure at the fixing nip portion fixes the unfixed toner image to the recording material surface, while the heat of the heater is provided through the fixing film. Members with low heat capacity are used for the heater and the fixing film in the fixing apparatus. The heater as a heat source can be energized to generate heat at a predetermined fixing temperature only during the execution of image formation. Therefore, there are advantages that the waiting time from power-on of the image forming apparatus to an image formation executable state is short and that the power consumption during standby is significantly small.

In the system, the fixing film sandwiches and conveys the recording material while sliding relative to the heater. To stabilize the rotation of the fixing film in this case, a configuration of providing a heat-resistant grease as a lubricant between the fixing film and the heater is disclosed in Japanese Patent Application Laid-Open No. 2003-045615.

In recent years, an image forming apparatus and a fixing apparatus with a larger number of printed sheets (higher productivity) per unit time are highly demanded by users. To execute the heat fixing process in the image forming apparatus faster, the recording material needs to be conveyed at a higher speed, and the rotational speed (process speed) of the fixing apparatus needs to be increased.

However, the increase in the process speed increases the speed fluctuation from the rotational speed during the print operation to the stop of the rotation of the fixing apparatus after the end of the print operation. In this case, a large acceleration fluctuation occurs at the fixing nip portion, and unpleasant stick-slip sound may be generated at a timing of the stop of the rotation of the fixing apparatus depending on the situation. The stick-slip sound is often generated when the viscosity of the lubricant is lowered in a state in which the image heating apparatus is warmed up as the heat fixing process is repeated.

SUMMARY OF THE INVENTION

An aspect of the present invention provides a fixing apparatus configured to fix a toner image to a recording material, the apparatus including: a cylindrical heating film; a nip portion forming member coming into contact with an inner surface of the film, wherein a lubricant is applied to a surface of the nip portion forming member coming into contact with the heating film; a roller forming a nip portion through the film along with the nip portion forming member, the roller configured to rotate to rotate the film; a motor configured to transmit driving force to the roller to rotate the roller; a control unit configured to control power supplied to the motor to adjust a rotational speed of the motor to a target rotational speed; and an acquisition unit configured to acquire information related to a warming condition of the apparatus, wherein the apparatus executes a fixing process of conveying and heating the recording material carrying the toner image to fix the toner image to the recording material at the nip portion, wherein the apparatus can execute first control of stopping the supply of power to the motor just after the end of the fixing process and second control of stopping the supply of power to the motor after a low-speed rotation period for rotating the motor at the target rotational speed set lower than the target rotational speed during the fixing process just after the end of the fixing process, and wherein the apparatus executes one of the first control and the second control based on the information at the start of the fixing process or just after the end of the fixing process.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

[First Embodiment]

(1) Example of Image Forming Apparatus

Figure 11:
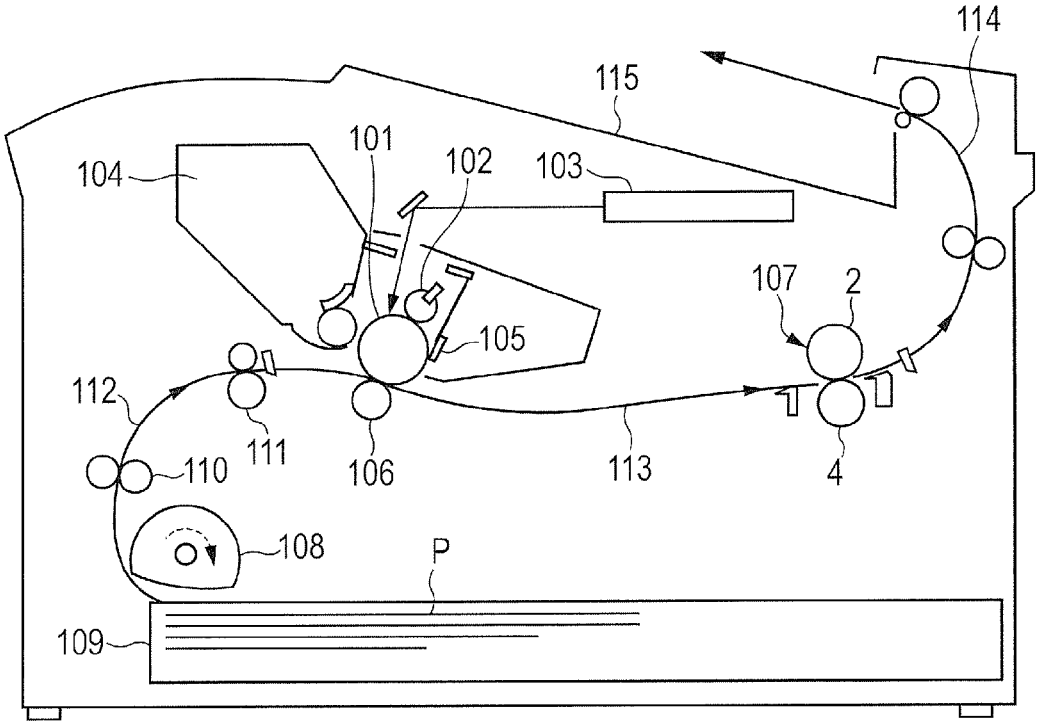
FIG. 11 is a schematic configuration diagram of an image forming apparatus provided with the image heating apparatus of the present embodiments.

FIG. 11 is a schematic configuration diagram of an example of an image forming apparatus provided with an image heating apparatus as a fixing apparatus (fixing device) according to the present embodiment. The image forming apparatus is a laser beam printer using a transfer electrophotographic process. The maximum width of paper that can be conveyed in the printer is an A4 size (210 mm). A conveyance standard of a recording material of the printer is a center conveyance standard in which the recording material is conveyed by bringing a center of a recording material conveyance path in a direction orthogonal to a conveyance direction of the recording material into line with a center between edges of the recording material in the direction.

An electrophotographic photosensitive drum (hereinafter, referred to as a photosensitive drum) 101 is an image carrier. The photosensitive drum 101 is rotated counterclockwise as indicated by an arrow, at a predetermined circumferential speed (process speed).

A charging unit 102 is, for example, a contact charging roller. The charging unit 102 uniformly charges (primarily charges) an outer circumferential surface (surface) of the photosensitive drum 101 with predetermined polarity and potential.

A laser beam scanner 103 is an image exposure unit. The laser beam scanner 103 outputs laser light after on/off modulation according to a time-series electrical digital pixel signal of objective image information input from an external device, such as an image scanner and a computer not illustrated, and scans and exposes (irradiates) a charging process surface of the photosensitive drum 101. The scan and the exposure remove the charge of an exposed bright section of the charging process surface of the photosensitive drum 101, and an electrostatic latent image corresponding to the objective image information is formed on the charging process surface.

A developing apparatus 104 supplies toner (developer) to the charging process surface of the photosensitive drum 101 from a developing sleeve not illustrated and develops an electrostatic latent image (electrostatic image) of the charging process surface as a toner image (development image). A reversal development system for attaching the toner to the exposed bright section of the electrostatic latent image to develop the image is generally used for the laser beam printer.

A transfer roller 106 is a contact and rotary transfer member. A transfer bias of a polarity opposite to the toner is applied to the transfer roller 106, and at a transfer section described later, the toner image of the photosensitive drum 101 is electrostatically transferred to the surface of a recording material P.

This is the configuration of an image forming mechanism unit as an image forming unit.

The recording material P is loaded and housed in a paper feed cassette 109. A paper feed roller 108 is driven based on a paper feed start signal, and the recording material P in the paper feed cassette 109 is separated and fed sheet by sheet. The recording material P passes through a sheet path 112 including a conveyance roller 110, a resist roller 111 and the like and is introduced to a transfer section that is a nip portion of the photosensitive drum 101 and the transfer roller 106 at a predetermined timing. More specifically, the resist roller 111 controls the conveyance of the recording material P such that the tip of the recording material P just reaches the transfer section when the tip of the toner image on the photosensitive drum 101 reaches the transfer section.

The recording material P introduced to the transfer section is sandwiched and conveyed through the transfer section, and meanwhile, a transfer voltage (transfer bias) controlled in a predetermined manner is applied from a transfer bias application power source not illustrated to the transfer roller 106.

The recording material P in which the toner image is transferred at the transfer section is separated from the surface of the photosensitive drum 101 and is conveyed and introduced to a fixing apparatus 107 as an image heating apparatus through a sheet path 113. The toner image is heated, pressurized and fixed here.

Meanwhile, a cleaning apparatus 105 removes residual transfer toner or paper dust from the surface of the photosensitive drum 101 after the separation of the recording material (after the transfer of the toner image to the recording material P) to clean the surface. The surface is repeatedly used to create images.

The recording material P passing through the fixing apparatus 107 is discharged onto a paper output tray 115 from an ejection port through a sheet path 114.

(2) Fixing Apparatus

Next, the fixing apparatus 107 in the present first embodiment will be described.

Figure 1:
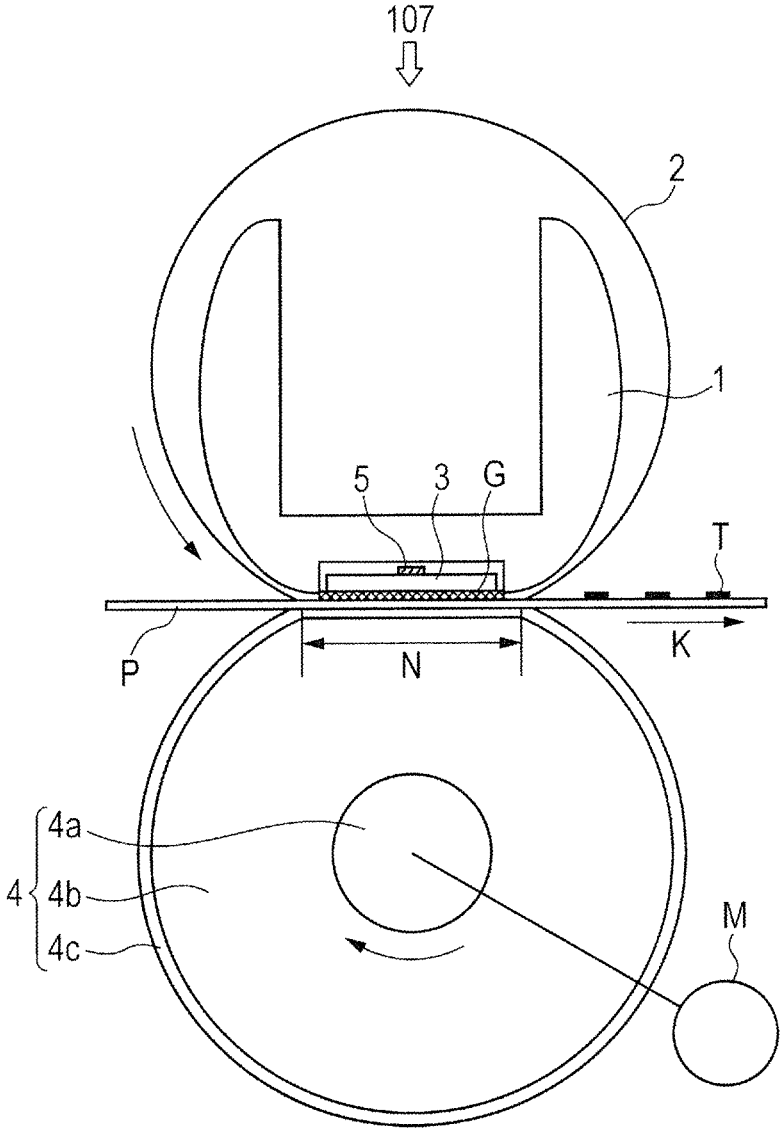
FIG. 1 is a schematic configuration diagram of an image heating apparatus of a film heating system in a first embodiment.

FIG. 1 is a schematic configuration diagram of a fixing apparatus of a film heating system according to the present embodiment. A heat-resisting fixing film (endless film) is used as a flexible member in a fixing apparatus of a tensionless-type film heating system. An endless-belt or cylindrical film is used as the fixing film. At least part of the circumferential length of the fixing film is always tension free (state without tension), and the fixing film is a device rotated by rotation of the pressure roller as a pressure body (backup member).

The fixing apparatus 107 includes: a fixing film 2 as a cylindrical film that is a rotatable flexible member; a heater 3 coming into contact with an inner surface of the fixing film 2; and a stay 1 as a holding member (support member) coming into contact with an inner circumferential surface of the fixing film 2 to hold the fixing film 2 from an inner circumferential surface and to support the heater 3. The fixing apparatus 107 further includes: a lubricant G applied between the fixing film 2 and the stay 1 and between the fixing film 2 and the heater 3 to improve slidability between them; and a pressure roller 4 as a pressure member configured to rotate while being pressurized and fitted to the fixing film 2 to form a fixing nip portion N. The fixing apparatus 107 further includes: a heater 3 as a heating unit configured to heat at least the fixing nip portion N by energization; and a fixing motor M as a drive unit configured to execute a heating process by rotating and driving the pressure roller 4 and sandwiching and conveying the recording material P carrying the toner image at the fixing nip portion N.

Configurations of the components will be described.

(2-1) Stay

The stay 1 is a support member configured to support the heater 3 and is a heat-resisting rigid member. An apparatus frame (not illustrated) holds edges of the stay 1 in a longitudinal direction. The heater 3 is arranged and held on a lower surface of the stay 1 in the longitudinal direction of the stay. Details of the heater 3 will be described later.

The stay 1 can be formed by a high heat resistance resin made of polyimide, polyamide imide, PEEK, PPS, liquid crystal polymer or the like or formed by a composite material of the resin and ceramics, metal, glass or the like. A liquid crystal polymer is used in the present embodiment.

(2-2) Fixing Film

The fixing film 2 is an endless (cylindrical) heat-resisting film (hereinafter, called a fixing film). The fixing film 2 is fitted onto the stay 1 holding the heater 3. The length of the inner circumference of the fixing film 2 is, for example, about 3 mm longer than the length of the outer circumferential of the stay 1 supporting the heater 3. Therefore, the fixing film 2 is fitted onto the stay 1 with a margin in the circumferential length. K denotes a recording material conveyance direction.

To reduce the heat capacity to improve the quick start property, the fixing film 2 can be a heat-resisting single layer film made of PTFE, PFA, FEP or the like or a composite layer film with a film thickness of 100 μm or less, preferably, 50 μm or less and 20 μm or more. In a generally used composite layer film, a base layer is a film made of polyimide, polyamide imide, PEEK, PES, PPS, SUS or the like. An elastic layer made of a material including a thermally conductive filler made of ZnO, $Al_2O_3$, SiC, metallic silicon or the like mixed in an elastic material, such as silicon rubber, is provided on the outer circumference in order to improve the fixing performance. PTFE, PFA, FEP or the like is further coated on an outermost surface. In the present embodiment, the base layer is a polyimide film with a film thickness of 50 μm, and the elastic layer is a mixed layer of silicon rubber and a thermally conductive filler with a thickness of 270 μm. PTFE is further coated on the outer circumferential surface. The outside diameter of the fixing film 2 is 24 mm.

(2-3) Pressure Roller (Pressure Member)

The pressure roller 4 is a roller member configured to sandwich the fixing film 2 between the pressure roller 4 and the heater 3 to form the fixing nip portion N with the heater 3 and configured to rotate and drive the fixing film 2. The pressure roller 4 includes: a cored bar 4*a* in a round shaft shape; an elastic body layer 4*b* provided in a roller shape on the outer circumferential surface of the cored bar 4*a*; and a release layer 4*c* as an outermost layer provided on the outer circumferential surface of the elastic body layer 4*b*. The pressure roller 4 is arranged in parallel to the fixing film 2, and both edges of the cored bar 4*a* in the longitudinal direction is rotatably held by an apparatus frame through a bearing (not illustrated). An urging unit (not illustrated), such as a pressure spring, urges the bearing by predetermined pressing force to cause the outer circumferential surface (surface) of the pressure roller 4 and the heater 3 to sandwich the fixing film 2, and the surface of the heater 3 is pressurized to elastically deform the elastic body layer 4*b* of the pressure roller 4 in the longitudinal direction. The elastic deformation of the elastic body layer 4*b* forms the fixing nip portion N with a predetermined width necessary to heat and fix an unfixed toner image T, between the outer circumferential surface (surface) of the fixing film 2 and the surface of the pressure roller 4. In the present embodiment, an aluminum cored bar is used for the cored bar 4*a*. Silicone rubber is used for the elastic body layer 4*b*. A PFA tube with a thickness of about 50 μm is used for the release layer 4*c*. The outside diameter of the pressure roller 4 is 25 mm, and the thickness of the elastic body layer 4*b* is about 4 mm. The pressing force for forming the fixing nip portion N with a predetermined width necessary for heating and fixing is 23 kgf in the present embodiment, and it is desirable that the pressing force is within a range of 22 kgf to 24 kgf even when the variation of component tolerance in manufacturing is taken into account.

The fixing motor M rotates and drives a drive gear (not illustrated) provided on one edge of the cored bar 4*a* in the longitudinal direction, and the pressure roller 4 is rotated clockwise indicated by an arrow at a predetermined circumferential speed. As a result of the rotation of the pressure roller 4, rotational force acts on the fixing film 2 due to friction force of the surface of the pressure roller 4 and the surface of the fixing film 2 at the fixing nip portion N. As a result, the inner circumferential surface (inner surface) of the fixing film 2 comes into contact with the surface of the heater 3 at the fixing nip portion N and slides, and the fixing film 2 follows and rotates around the perimeter of the stay 1 counterclockwise as indicated by an arrow at substantially the same circumferential speed as the rotation circumferential speed of the pressure roller 4.

A motor, such as a DC brushless motor and a stepping motor, can be used as the fixing motor M for transmitting the drive force to rotate the pressure roller 4. A DC brushless motor is used as the fixing motor M in the present embodiment. The fixing motor M includes an IC circuit not shown, and an FG signal during the rotation of the fixing motor M can be monitored to adjust (control) the amount of supplied current (power) to provide predetermined signal intervals. This allows operation at a desirable rotational speed (target rotational speed). The operation of the fixing motor M during the heat fixing process in the present embodiment will be described later.

(2-4) Heater

The heater 3 is a heating body arranged inside of the fixing film 2 and is configured to heat the fixing nip portion N that fuses and fixes the toner image T on the recording material. For example, the heater 3 includes a highly insulating elongated ceramic substrate made of alumina (aluminum oxide), AlN (aluminum nitride) or the like or includes a heat-resisting resin substrate made of polyimide, PPS, liquid crystal polymer or the like. A heat generation body, a glass coat layer and the like are sequentially formed on the surface of the substrate, wherein a heat generation paste layer made of, for example, Ag/Pd (silver-palladium) is printed on the heat generation body, and the glass coat layer is for protecting the heat generation body and ensuring insulation. In the present embodiment, alumina is used for the substrate, and the heat generation paste layer and the glass coat layer are formed closer to the fixing nip portion N relative to the substrate.

A power feeding unit not illustrated feeds power to the heat generation paste on the heater 3 through a connector not illustrated. A temperature detection element 5, such as a thermistor, configured to detect the temperature of the heater 3 elevated according to the heat generation of the heat generation paste is arranged on the back side of the heater 3. The duty ratio, the wave number and the like of the voltage applied from an electrode unit not illustrated at an edge in the longitudinal direction to the heat generation paste are appropriately controlled according to a signal of the temperature detection element 5 to maintain the inside of the fixing nip portion N at substantially a constant controlled temperature. In this way, the heater 3 performs heating necessary to fix the unfixed toner image T on the recording material P through the fixing film 2.

A thin-layer protection layer, such as a glass coat, a fluorine resin layer and a polyimide layer, that can withstand rubbing with the inner circumferential surface (surface) of the fixing film 2 can be provided on the surface of the heater 3 closer to the fixing nip portion. A glass coat layer is used as the protection layer in the present embodiment.

(2-5) Lubricant G

The lubricant G is provided on the contact surface of the heater 3 and the fixing film 2 and is provided for the purpose of ensuring the slidability of the fixing film 2 and ensuring the running stability of the fixing film 2. Since the temperature of the heater 3 becomes as high as about 250° C., Molykote HP-300 (manufactured by Dow Corning Toray) that is a fluorine grease with excellent heat resistance is used in the present embodiment. Although the applied amount is 500 mg in the present embodiment to ensure the slidability and to ensure the running stability of the fixing film 2, it is desirable that the applied amount is 450 mg or more to attain the same objects. It is desirable that the applied amount is suppressed to 550 mg or less to inhibit electric heating from the heater 3 and to prevent deterioration of the heating and fixing performance efficiency. The lubricant is not limited to this as long as the lubricant has a similar performance.

[Description of Oil Film Shortage of Lubricant]

Next, an ideal state of the lubricant and a state of the lubricant in an oil film shortage will be described with reference to FIGS. 2A and 2B.

Figure 2A:
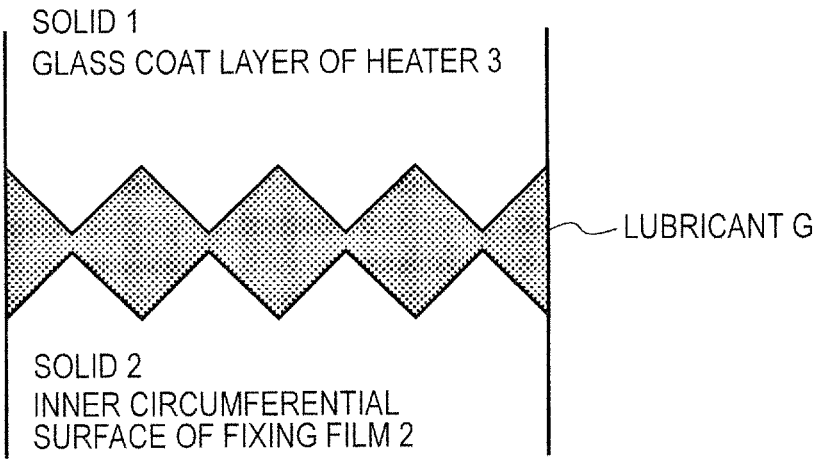
FIG. 2A is a conceptual diagram describing a state without an oil film shortage of a lubricant.

FIG. 2A illustrates an ideal state of the lubricant.

The ideal state of the lubricant G is a state in which a lubricating film of the lubricant G is formed between two sliding solids, and stable slidability can be ensured. Note that the two solids in the present embodiment are the glass coat layer of the heater 3 and the inner circumferential surface of the fixing film 2.

Figure 2B:
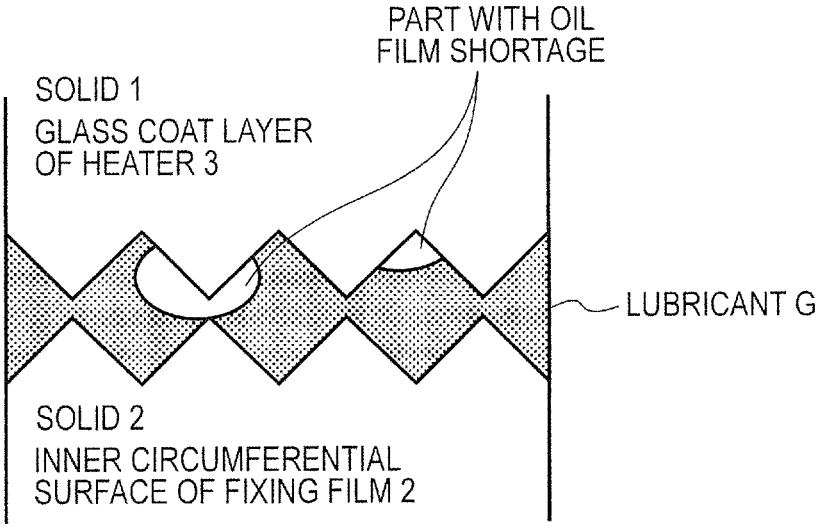
FIG. 2B is a conceptual diagram describing a state with the oil film shortage of the lubricant.

FIG. 2B illustrates a state of the lubricant with an oil film shortage (lubricating film shortage).

In the state with the oil film shortage, part of the lubricant G between two solids are unsteadily deficient, and the two solids come into direct contact with each other. The degree and the range of the oil film shortage unsteadily change. Therefore, when the range where the two solids come into direct contact with each other becomes wide, the slidability may be destabilized, or a minute slip may occur. Generally known examples of a condition that deteriorates the oil film shortage include lowering of the viscosity of the lubricant G and lowering of the rotational speed. When the condition is applied to the fixing apparatus 107, a state in which the fixing device is warmed up to a significantly high temperature (hot state) after execution of a large amount of the fixing process corresponds to the condition in terms of lowering of the viscosity of the lubricant G. A process of stopping the rotation of the fixing apparatus 107 after the execution of the fixing process corresponds to the condition in terms of lowering of the sliding speed.

[Description of Fixing Motor Operation and Stick-Slip Sound Generation Mechanism]

Next, a generation mechanism of stick-slip sound in a rotation stop period of the fixing motor M will be described.

Figure 4A:
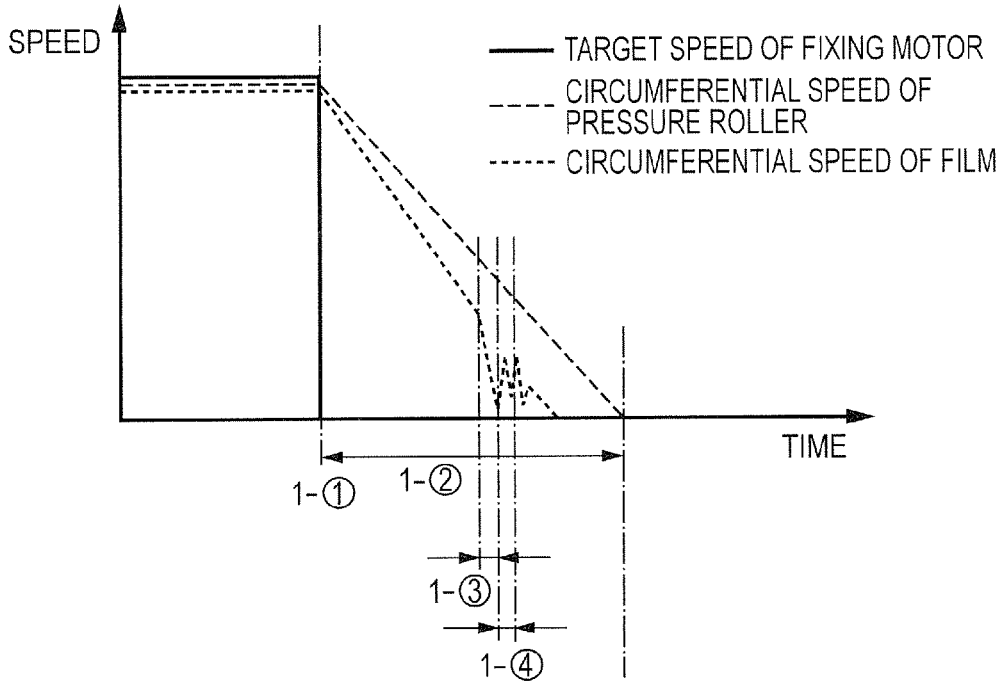
FIG. 4A is an explanatory diagram of a mechanism of suppression of stick-slip sound.

FIG. 4A illustrates rotation stop operation of the fixing motor M when low-speed rotation control is not performed according to a comparative example of the present embodiment. FIG. 4A describes a target rotational speed of the fixing motor M, a rotational speed of the pressure roller 4 driven by the fixing motor M, and a rotational speed of the fixing film 2 following the pressure roller 4 to rotate.

When the fixing process ends, the supply of power to the fixing motor is stopped to stop the rotation of the fixing motor M (target rotational speed is set to 0 mm/s) (symbol 1-1 (circled number in FIG. 4A)). In this case, the rotation of the pressure roller 4 does not immediately stop, and the rotation decelerates with certain inertia to stop (symbol 1-2 (circled number in FIG. 4A)). At this point, the rotational speed of the fixing film 2 decelerates at a slightly slower speed than the rotational speed of the pressure roller 4, because the rotational speed fluctuation of the pressure roller 4 is large.

However, the oil film shortage tends to occur in a state in which the temperature of the fixing apparatus 107 is relatively high and a state just before the stop in which the rotational speed of the fixing film 2 is relatively low after deceleration. The friction force acting on the fixing film 2 from the heater 3 instantaneously becomes larger than the driving force acting on the fixing film 2 from the pressure roller 4, and the rotation of the fixing film 2 may rapidly decelerate or stop for a minute time (symbol 1-3 (circled number in FIG. 4A)). Even when the oil film shortage occurs, the state, the degree and the range of the oil film shortage are not steadily the same. Therefore, the fixing film 2 may start rotating again if the rotational speed of the pressure roller 4 driving the fixing film 2 is relatively large after the rotation of the fixing film 2 has become unstable (symbol 1-4 (circled number in FIG. 4A)). If the states of symbol 1-3 and symbol 1-4 are repeated, the fixing film 2 vibrates, and stick-slip sound is generated.

The generation mechanism of the stick-slip sound under the hot condition with the oil film shortage of the lubricant G is described here. However, the oil film shortage easily occurs in the hot state in which the fixing apparatus 107 is relatively warmed up as described above. For example, in a cold state in which the oil film shortage does not easily occur, and the fixing apparatus 107 is relative cold, the stick-slip sound is not generated even under the control in a conventional example, or the stick-slip sound is significantly small even if the stick-slip sound is generated.

[Stop Control Configuration]

Figure 8:
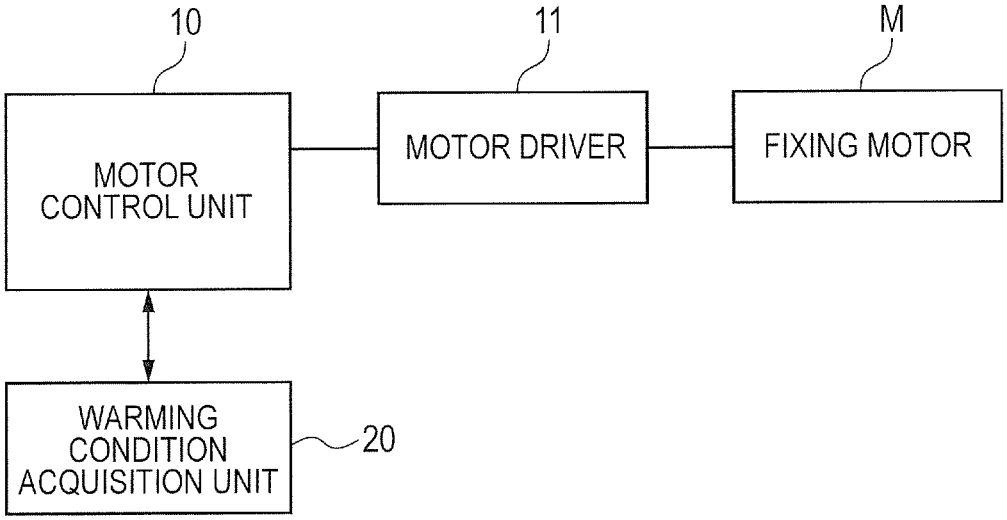
FIG. 8 is a control block diagram of the first embodiment.

FIG. 8 illustrates a control block diagram of a stop control configuration of the present embodiment.

More specifically, the configuration includes: an acquisition unit 20 as an acquisition section of a warm-up condition (information related to a warming condition, also called "warm state", of the fixing apparatus); and a motor control unit 10 configured to change a control condition in stopping the fixing motor M according to an acquisition result of the acquisition unit 20 after the end of the heating process. The fixing motor M is driven through a motor driver 11 based on a control signal from the motor control unit 10.

The acquisition unit 20 acquires information of the warming condition of the fixing apparatus or the pressure roller 4 warmed by the heat flowing from the heater 3.

After the end of the heating process, the motor control unit 10 changes the control condition in stopping the drive of the fixing motor M from a condition of stopping the drive at the end of the image heating to a condition of controlling the deceleration for a certain period until the drive of the fixing motor M stops. In the control of the deceleration, the drive is stopped after the speed is controlled and decelerated to a speed slower than the drive speed (process speed) during the heating process.

The energization time (power supply time) of the heater 3 is reflected on the acquisition unit 20 in the first embodiment, and details will be described later.

The function of the motor control unit 10 is realized by a CPU and a memory, and the following procedure is executed based on a program stored in the memory. More specifically, after the end of the heating process (just after the fixing process is finished), the motor control unit 10 determines whether the pressure roller 4 has reached a predetermined high temperature state in which the oil film shortage may occur. If the pressure roller 4 has not reached the high temperature state, the supply of power to the fixing motor M is stopped. If the pressure roller 4 has reached the high temperature state, the low-speed rotation control for reducing the speed of the fixing motor M to a speed slower than the speed during the heating process (during the fixing process) is performed, and then the fixing motor M is stopped.

Figure 3:
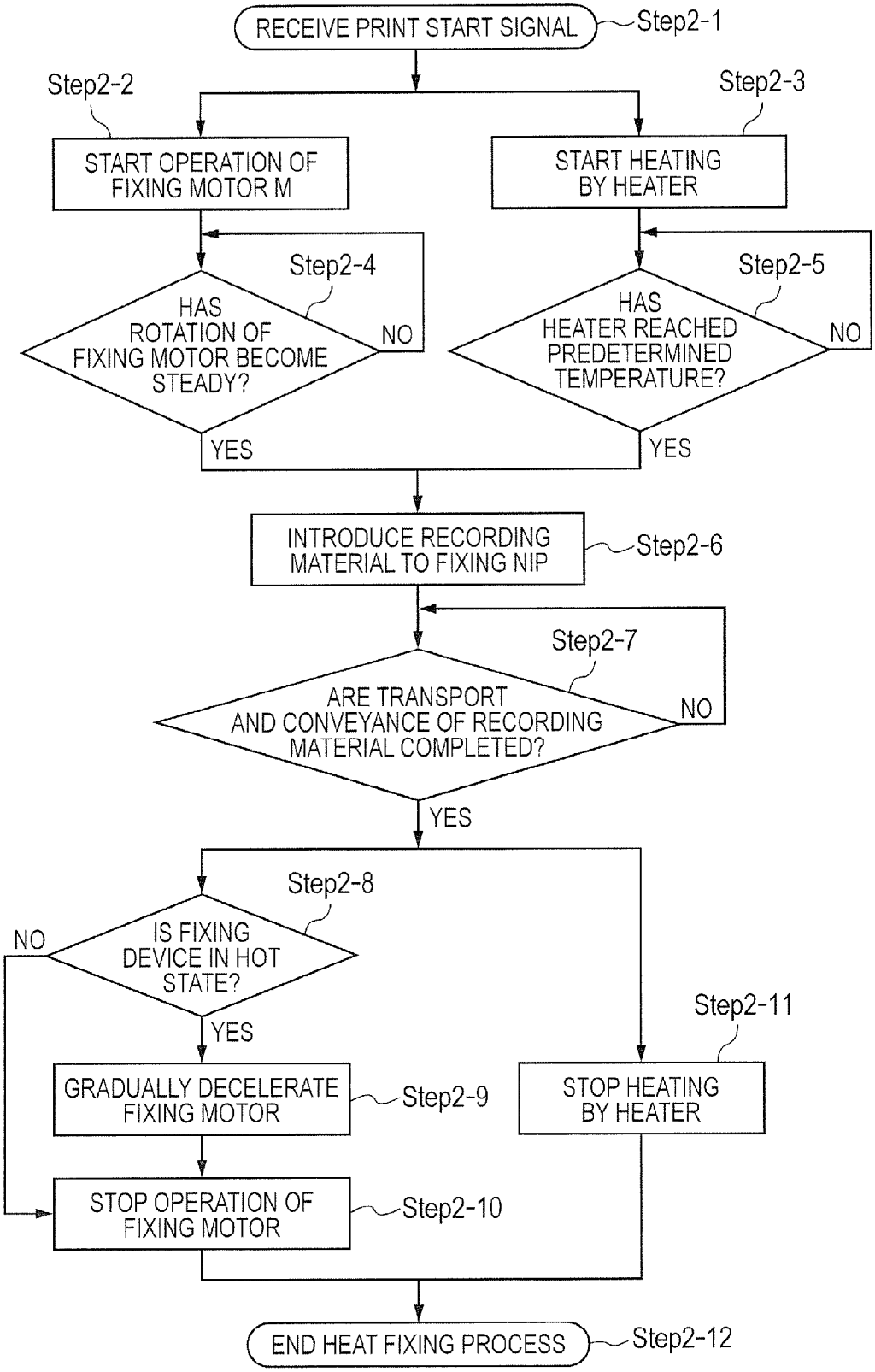
FIG. 3 is a flow chart illustrating operation procedure of a fixing motor in the first embodiment.

FIG. 3 is a flow chart describing operation of the fixing motor of the present embodiment.

When a print start signal according to image information input from an external host apparatus not illustrated is received (Step 2-1), energization of the fixing motor M is started, and the pressure roller 4 is rotated through a drive gear not illustrated (Step 2-2).

Energization of the heater 3 is started, and the fixing apparatus 107 starts to warm up (Step 2-3). The rotational speed of the fixing motor M becomes steady at a predetermined speed of executing the heat fixing process (Step 2-4). In a state that the temperature of the heater 3 has risen to a predetermined temperature (Step 2-5), the recording material P carrying the toner image T is introduced to the fixing nip portion N with the toner image carrier surface facing the fixing film 2 (Step 2-6).

The recording material P comes into close contact with the heater 3 through the fixing film 2 at the fixing nip portion N and moves and passes through the fixing nip portion N along with the film 2. Heat is provided to the recording material P, and the toner image T is heated and fixed to the surface of the recording material P. The recording material P passing through the fixing nip portion is separated from the surface of the fixing film 2, and after a lapse of time enough to discharge and convey the recording material P (Step 2-7), the process shifts to the control of the fixing motor M that is a feature of the present embodiment.

Conventionally, only the control (first control) of stopping the supply of power to the fixing motor M just after the end of the target rotational speed fixing process (setting the target rotational speed to 0 mm/s) is carried out. On the other hand, whether the fixing apparatus 107 is in the hot state is first determined in the present embodiment. If the fixing apparatus 107 is in the hot state, it is determined that the oil film shortage (lubricating film shortage) of the lubricant G may occur (Step 2-8). In this case, the low-speed rotation control (second control) is performed in which in a certain section before the fixing motor M is stopped, there is a low-speed rotation period for setting a target rotational speed lower than the target rotational speed of the fixing motor M during the heat fixing process (Step 2-9), and then the supply of power to the fixing motor M is stopped (Step 2-10). It is desirable that the time of the low-speed rotation period is sufficiently longer than the inertia time of the pressure roller 4 generated in the conventional example. In the present embodiment, whether there is an oil film shortage is determined by focusing on the warming condition of the fixing device. A method of detecting the warming condition of the fixing device will be described later.

Next, a mechanism of suppressing the stick-slip sound in the rotation stop period of the fixing motor M in the present embodiment will be described with reference to FIG. 4B.

Figure 4B:
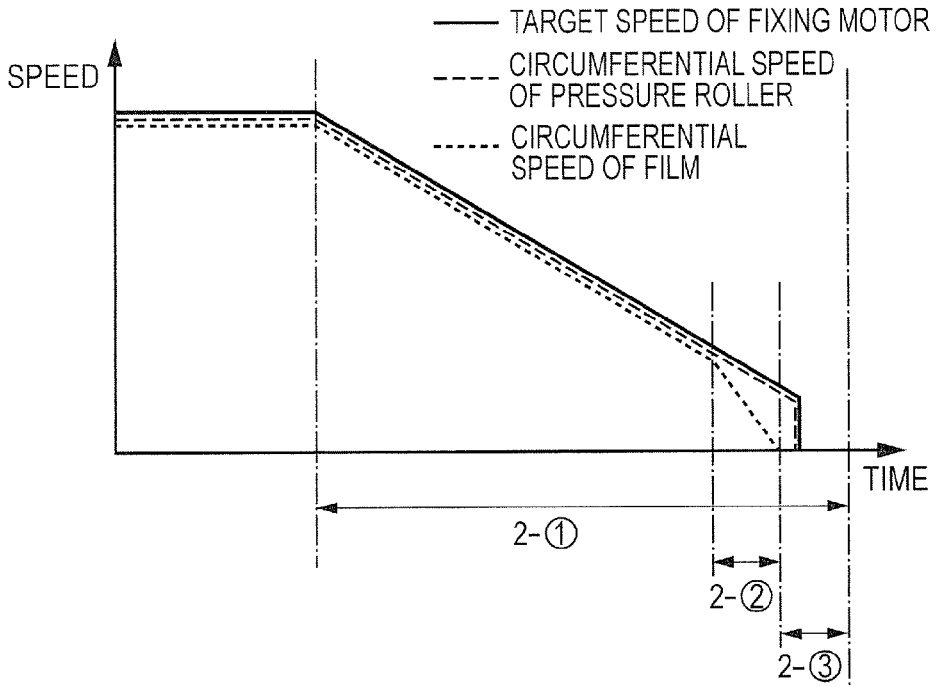
FIG. 4B is an explanatory diagram of a mechanism of generation of stick-slip sound.

FIG. 4B describes the target rotational speed of the fixing motor M, the rotational speed of the pressure roller 4 and the rotational speed of the fixing film 2 as in FIG. 4A.

Just after the end of the fixing operation, a low-speed rotation period of a certain period is provided, and the target rotational speed of the fixing motor M is gradually lowered (symbol 2-1 (circled number in FIG. 4B)). In this case, although the rotational speed of the pressure roller 4 is lowered as in the conventional example, the speed fluctuation per unit time is smaller than in the conventional example. Therefore, the rotational speed of the fixing film 2 lowers at a speed substantially equal to the rotational speed of the pressure roller 4.

Subsequently, as in the conventional example, the rotation of the fixing film 2 may stop even during the rotation of the pressure roller 4 in the state with the oil film shortage (symbol 2-2 (circled number in FIG. 4B)). However, as a result of performing the stop control of the fixing motor M of the present embodiment, the power acting from the pressure roller 4 at the stage of the stop of the fixing film 2 is relatively small, and this prevents the fixing film 2 from starting to rotate again (symbol 2-3 (circled number in FIG. 4B)). The mechanism can suppress the stick-slip sound in the rotation stop period of the fixing motor M.

[Warming Condition of Fixing Apparatus and Fixation Count Prediction System]

As described, in the state in which the fixing apparatus 107 is warmed up so that the oil film shortage of the lubricant G occurs, the stick-slip sound is generated in the rotation stop period of the fixing motor M, and it is desirable to carry out the low-speed rotation control of the fixing motor M described above.

On the other hand, in the state in which the fixing apparatus 107 is relatively cold so that the oil film shortage of the lubricant G does not occur, the stick-slip sound is not generated even if the low-speed rotation control of the fixing motor M described above is not carried out. Not only that, the rotation time of the fixing apparatus 107 is extended on some level if the low-speed rotation control described above is carried out, and the durability of the fixing film 2, the pressure roller 4 and the like may be deteriorated. Therefore, it is desirable that the low-speed rotation control is not carried out under an unnecessary condition.

The warming condition of the fixing device and a method of predicting the warming condition of the fixing device will be described here.

The warming condition of the fixing apparatus 107 will be described first. It is generally known that the heat generated by the heater 3 heats and fixes the unfixed image (toner image) T on the recording material P to the surface of the recording material P, and part of the heat also flows into, for example, the pressure roller 4 with a relatively large heat capacity. Therefore, the temperature of the pressure roller 4 gradually rises as the print operation is repeated. This phenomenon continues until the heat balance of the amount of heat flowing to the pressure roller 4 and the amount of heat released from the pressure roller 4 is balanced. Therefore, it can be stated that in the state in which the temperature of the pressure roller 4 is relatively low, the heat generated by the heater 3 easily flows into the pressure roller 4 compared to the high temperature state. In the present embodiment, the temperature of the pressure roller 4 is focused as an index of the tendency of the heat flowing into the pressure roller 4, and this is defined as a warming condition of the fixing apparatus 107.

Next, the acquisition unit 20 will be described.

A fixation count prediction system is adopted in the present first embodiment, in which the warming condition of the pressure roller 4 is predicted as information of the warming condition of the pressure roller 4 acquired by the acquisition unit 20.

The energization time of the heater 3 is reflected on the fixation count prediction system. The print operation that is heating process operation is divided into a plurality of stages in the embodiment, and for each operation stage, a value proportional to the amount of heat provided to the pressure member per unit time is set in advance as a coefficient. After every predetermined time in each operation stage, an integration count obtained by adding the coefficients is set as the information of the warming condition, and the temperature of the pressure roller 4 is predicted according to the integration count.

Specifically, the print operation is divided into four stages, a preheating period, a paper feeding period, a period between sheets and a main body stop period. The preheating period is a time from the start of the energization of the heater 3 to the introduction of the recording material P to the fixing nip portion N, and the paper feeding period is a time from the introduction of the recording material P to the fixing nip portion N to the discharge of the recording material P. The period between sheets is a time from the ejection of the recording material P from the fixing nip portion N to the introduction of the next consecutive recording material P to the fixing apparatus 107, and the main body stop period is a time in which the print operation is finished. A different coefficient is set for each divided time (called an operation state or an operation stage). The coefficient is a value proportional to the amount of heat provided to the pressure roller 4 per unit time and is calculated from a difference in the amount of input power or a difference in the amount of released heat in each operation time.

The coefficients are values as set in the following Table 1 in the present embodiment. Each coefficient is added every 200 msec set as the unit time in each operation state (or called an operation state), and the temperature of the pressure roller 4 is predicted according to the integration count.

Therefore, each coefficient is stored in a memory not illustrated, and the acquisition unit 20 is configured to read out the corresponding coefficient from the memory according to each operation stage and add the coefficient every unit time to acquire the integration count.

Note that the integration count is reset when the power of the main body is turned off. However, when the power is turned on, an initial value of the integration count is determined based on the information of the temperature detection element 5. After that, the coefficient is sequentially added to the initial value every time the time has passed.

When an environment detection sensor that measures the temperature and humidity of the installation environment is adopted, the coefficient to be added may be corrected based on temperature or humidity information. In this case, differences in the temperature of the recording material P, the amount of heat released from the pressure roller 4, the amount of input power and the like that vary in each environment are taken into account as factors that affect the temperature of the pressure roller 4, and this is intended to improve the accuracy of the temperature prediction of the actual pressure roller 4.

The method of predicting the warming condition of the pressure roller 4 may be a method of determining the warming condition from the number of printed sheets that is the number of heated recording sheets, and the method is not limited to the system described above. For example, it may be simply determined that the pressure roller 4 is in the high temperature state (hot state) in which the oil film shortage of the lubricant G may occur, when the temperature of the temperature detection element 5 is higher than a certain temperature at the start of the print operation (at the start of the fixing process). A temperature detection element configured to detect the temperature of the pressure roller 4 may also be provided.

Figure 5:
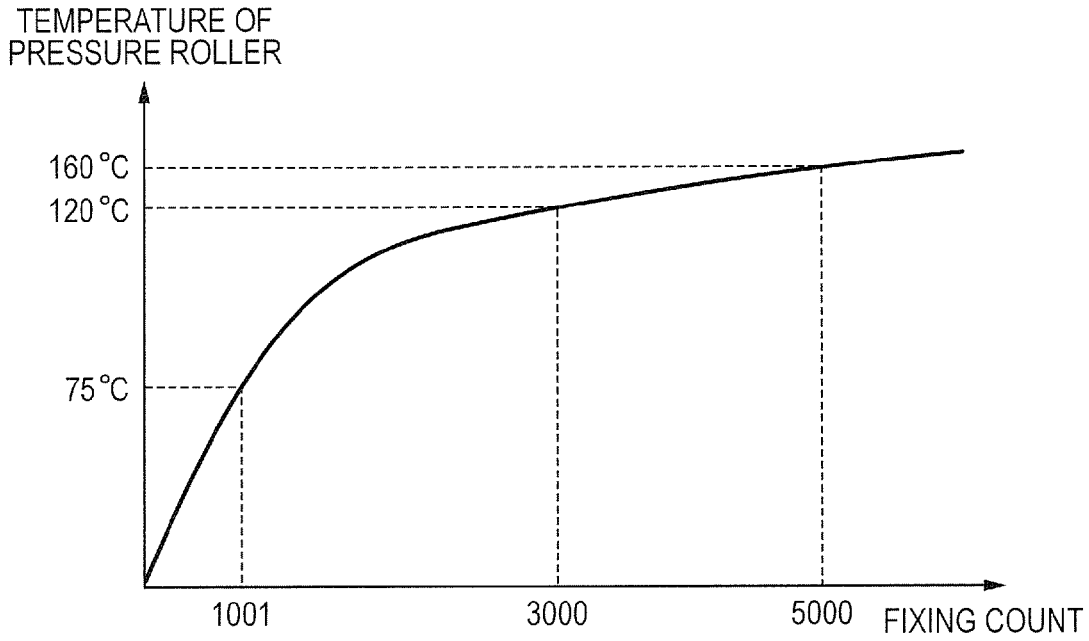
FIG. 5 is a relationship diagram of pressure roller temperature and a fixation count predicated value in the first embodiment.

FIG. 5 illustrates a relationship between the integration count in the fixation count prediction system and the temperature of the pressure roller 4.

Based on the present system, the colder the pressure roller 4, the smaller the fixation count becomes. For example, when the temperature of the pressure roller 4 is relatively low at about 75° C. after print operation of only several sheets, the fixation count is about 1001, and it can be determined that the fixing apparatus 107 is in the cold state (state without the oil film shortage of the lubricant G). The hotter the pressure roller 4, the larger the fixation count becomes. An example of this includes a case in which the temperature of the pressure roller 4 is relatively high at about 120° C. in a state after execution of a large amount of continuous printing or in a state of intermittent printing with repetition of preheating operation although the number of printed sheets is small. In this case, the fixation count is about 3000, and it can be determined that the pressure roller 4 is in the hot state.

TABLE 1

| | Integration count | | |
|---|---|---|---|
| Operation state | 0 to 1000 | 1001 to 3000 | ≥3001 |
| Preheating state | 7 | 5 | 3 |
| Paper feeding period | 5 | 3 | 1 |
| Period between sheets | 3 | 2 | 1 |
| Main body stop period | −5 | −10 | −20 |

[Performance Evaluation of the Present Embodiment]

Next, a performance evaluation test of the present first embodiment will be described.

The probability of generation of the stick-slip sound in the rotation stop period of the fixing motor M is evaluated for a first comparative example that is an example in which the low-speed rotation control of the present embodiment is not performed, and the evaluation is performed under four control conditions for the embodiment in which the low speed rotation control of the present embodiment is performed.

Common conditions of the evaluation test include a process speed of 350 mm/s, a measurement environment temperature of 25° C., and 230° C. for the control temperature of the temperature detection element 5 during the heat fixing process. After the execution of the heat fixing process, the low-speed rotation control is performed under each condition described in Table 2.

A decrease time a in Table 2 will be described first with reference to FIG. 6.

Figure 6:
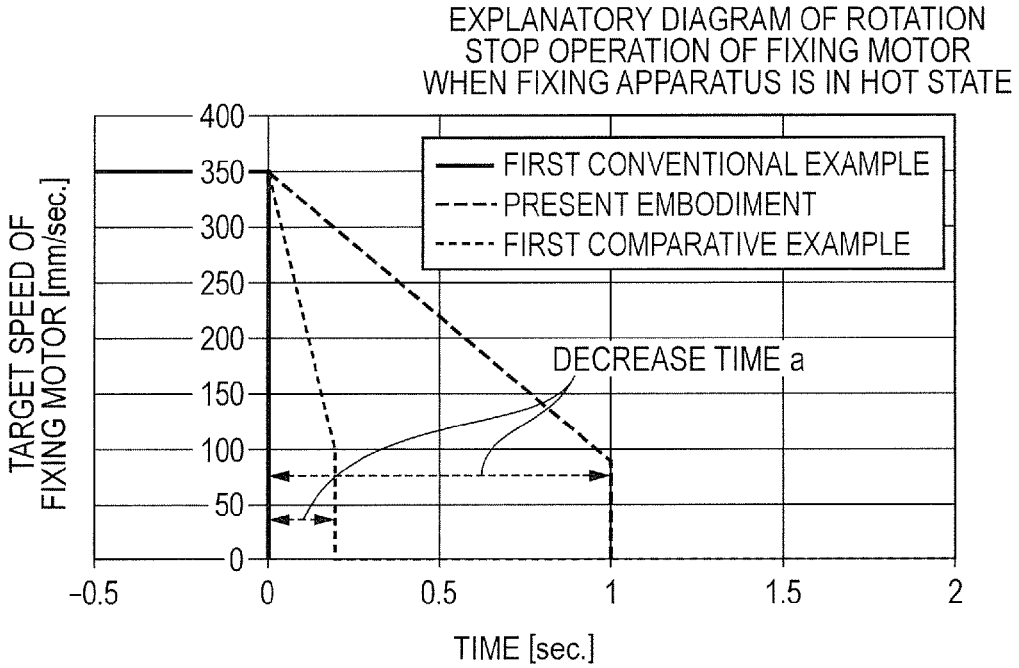
FIG. 6 is an explanatory diagram of low-speed rotation control of the fixing motor in the first embodiment and a comparative example.

FIG. 6 describes the comparative example and the low-speed rotation control condition of the fixing motor M in the hot state of the present embodiment. The time of 0 seconds in FIG. 6 indicates the end of the heating process, i.e. timing of the end of the heat fixing process. In the control of the comparative example, the target rotational speed of the fixing motor M is set to 0 mm/s at the end of the heat fixing process as described above.

On the other hand, the characteristic point of the present first embodiment is that the supply of power to the fixing motor M is stopped after reducing the target rotational speed of the fixing motor M in a certain section (low-speed rotation period) to a speed slower than the process speed in the low-speed rotation control of the fixing motor M. The certain section (low-speed rotation period) in this case is defined as a decrease time a. The target rotational speed after a lapse of the decrease time a is set to 87.5 mm/s.

The fixation count prediction system is used to determine whether there is an oil film shortage of the lubricant G. In the present first embodiment, it is determined that a condition with the fixation count of less than 3000 is the state in which the fixing apparatus 107 is relatively cold so that the oil film shortage does not occur. On the other hand, it is determined that a condition with the fixation count of 3000 or more is the state (hot state) in which the fixing apparatus 107 is relatively warmed up so that the oil film shortage may occur.

TABLE 2

| | Decrease time a | Fixation count | Probability of generation of stick-slip sound |
|---|---|---|---|
| Comparative example | None | 1001 | Not generated |
| | | 3000 | Generated 100% |
| Control condition 1 of present embodiment | None | 1001 | Not generated |
| | 1.0 s | 3000 | Not generated |
| Control condition 2 of present embodiment | 0.2 s | 3000 | Generated about 80% |
| Control condition 3 of present embodiment | 0.4 s | 3000 | Generated about 20% |
| Control condition 4 of present embodiment | 2.0 s | 3000 | Not generated |

In the control performed in the comparative example, the target rotational speed of the fixing motor M is set to 0 mm/s at the end of the heat fixing process regardless of the value of the fixation count that is the integration count. In this case, the stick-slip sound is not generated under the condition with the fixation count of 1001 in which the oil film shortage does not occur. However, the stick-slip sound is generated with a probability of 100% under the condition with the fixation count of 3000 in which the oil film shortage may occur.

Meanwhile, in the cases of the control conditions 1 to 4 of the present embodiment, the control of setting the target rotational speed of the fixing motor M to 0 is performed at the end of the heat fixing process under the condition in which the fixation count is less than 3000, as in the comparative example.

On the other hand, under the condition in which the fixation count is equal to or greater than 3000, the low-speed rotation control is performed for the decrease time a under each control condition.

The decrease time a is set to 1.0 s under the control condition 1, and excellent results are obtained under all conditions without the generation of the stick-slip sound regardless of the warming condition of the fixing apparatus 107. Not only that, the decrease time a is not provided under the condition in which the fixing apparatus 107 is relatively cold so that the stick-slip sound is not generated in the first place. Therefore, unnecessary rotation of the fixing apparatus 107 is suppressed, and it can be stated that the control is also desirable in terms of durability.

The decrease time a is set to 0.2 seconds and 0.4 seconds under the control conditions 2 and 3, respectively. Although the generation of the stick-slip sound cannot be completely suppressed, an advantageous effect of reducing the probability is obtained.

The decrease time a is set to 2.0 seconds under the control condition 4, and an excellent result is obtained for the probability of the stick-slip sound as in the control condition 1. On the other hand, the travel distance of the fixing apparatus 107 in the rotation stop period of the fixing motor M is longer than the control condition 1, and the control condition 1 is preferable in terms of durability.

Figure 7:
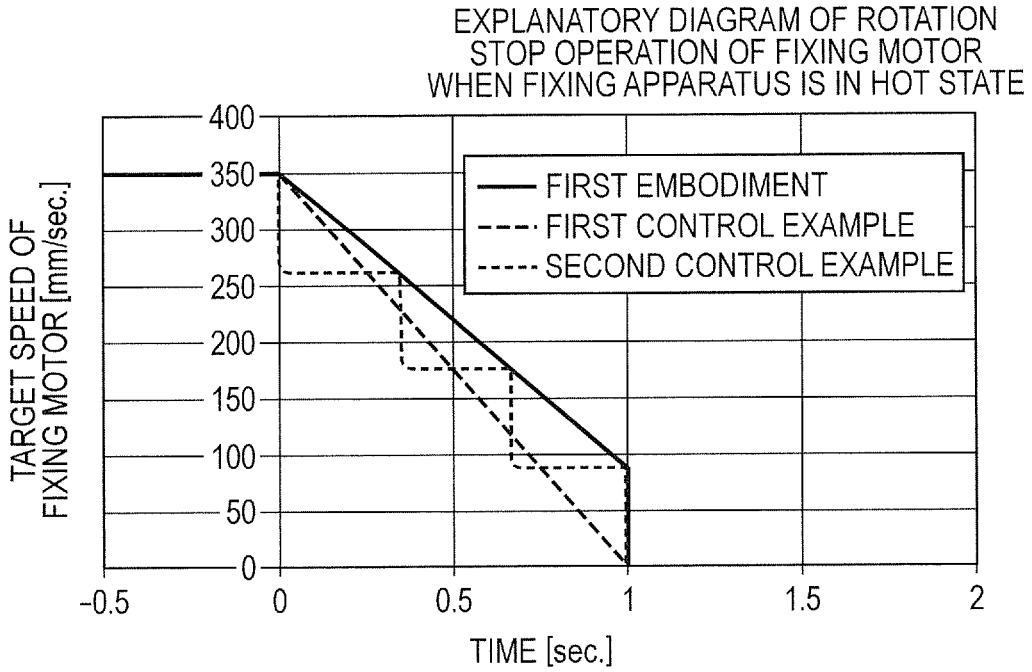
FIG. 7 is an explanatory diagram of an example of the low-speed rotation control of the fixing motor that can be applied to the first embodiment.

Although the target rotational speed after the lapse of the decrease time a is set to 87.5 mm/s in the description of the present embodiment, the present embodiment is not limited to this. For example, as described in a first control example in FIG. 7, the target rotational speed after the lapse of the decrease time a can be set to, for example, 0 mm/s to reduce the inertia in the rotation stop period of the pressure roller 4 to reduce the stick-slip sound.

Although the target rotational speed in the rotation stop period of the fixing motor M is continuously changed in the description of the present embodiment, the present embodiment is not limited to this. For example, as described in a second control example in FIG. 7, the target rotational speed in the decrease time a can be lowered in, for example, three stages to obtain an advantageous effect similar to the present embodiment.

(Second Embodiment)

Next, a second embodiment will be described.

The second embodiment is different from the first embodiment in that a plurality of types of control conditions for stopping the rotation are set according to a degree of the high temperature state in which the lubricating film shortage of the lubricant may occur, specifically, according to a value of the fixation count.

More specifically, when the temperature reaches the high temperature state in which the lubricating film shortage of the lubricant may occur in the first embodiment, the low-speed rotation control of the fixing motor M is uniformly controlled by the decrease time a even if the temperature becomes higher than that.

On the other hand, the high temperature state in which the lubricating film shortage of the lubricant may occur is divided into a plurality of stages in the present second embodiment, and a plurality of types of conditions for the low-speed rotation control are set according to the high-temperature state of each stage.

Specifically, for the plurality of types of control conditions for the low-speed rotation control, the decrease time a is set to 0.8 s when the number of fixation counts is 3000 or more and 4000 or less, and the decrease time a is set to 1.0 s when the number of fixation counts is 4000 or more. Therefore, the decrease time a that is a control time until the speed reaches the target rotational speed after the low-speed rotation control is set longer for a stage with higher temperature.

The decrease time a is stored in advance as data in a memory. The target rotational speed is set such that the speed proportionately decreases in the decrease time a, and the fixing motor M is controlled.

As described in the first embodiment, the oil film shortage of the lubricant G easily occurs when the fixing apparatus 107, i.e. the pressure roller 4, enters the hot state. The probability of the oil film shortage is affected by the warming condition of the pressure roller 4, i.e. the degree of the hot state. More specifically, the higher the temperature, the higher the probability of the oil film shortage. This point is focused in the present embodiment, and the characteristic point of the present embodiment is that the decrease time a is changed according to the degree of the hot state of the pressure roller 4.

Figure 9:
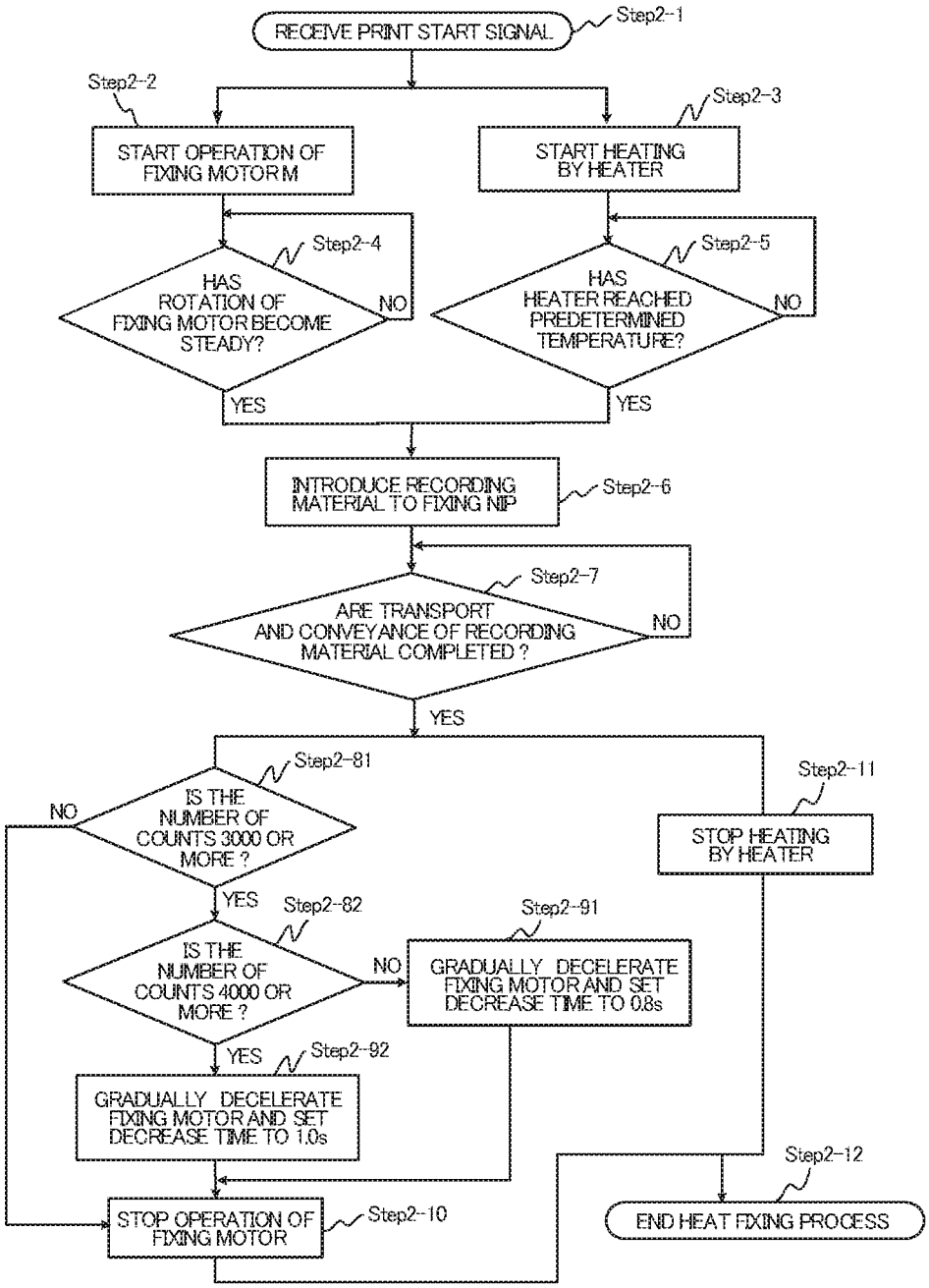
FIG. 9 is a flow chart of stop control of the fixing motor in a second embodiment.

FIG. 9 illustrates a flow chart of the low-speed rotation control part of the operation of the fixing motor. The operation procedure of the fixing motor is the same procedure as in the flow chart illustrated in FIG. 3, and Step 2-8 and Step 2-9 include two stages in the present embodiment.

More specifically, when the transport and the conveyance of the recording material are completed (Step 2-7), whether the number of fixation counts is equal to or greater than 3000 is determined (Step 2-81). If the number of fixation counts is smaller than 3000, the supply of power to the fixing motor M is stopped to stop the operation of the fixing motor (Step 2-10). If the number of fixation counts is equal to or greater than 3000, whether the number of fixation counts is equal to or greater than 4000 is determined (Step 2-82). If the number of fixation counts is less than 4000, the decrease time a is set to 0.8 s, and the low-speed rotation control is performed (Step 2-91). The supply of power to the fixing motor M is stopped after the low-speed rotation control (Step 2-10). If the number of fixation counts is equal to or greater than 4000, the decrease time a is set to 1.0 s, and the low-speed rotation control is performed (Step 2-92). The supply of power to the fixing motor M is then stopped (Step 2-10).

The other configuration and control are the same as in the first embodiment, and the description will not be repeated.

[Performance Evaluation of the Present Second Embodiment]

Like the conditions in the first embodiment, the common conditions include the process speed of 350 mm/s, the measurement environment temperature of 25° C., and 230° C. for the control temperature of the temperature detection element 5 during the heat fixing process. After the execution of the heat fixing process, the low-speed rotation control of the fixing motor M is performed under each condition described in Table 3 to evaluate the probability of generation of the stick-slip sound.

In the present embodiment, the decrease time a is not provided as in the first conventional example in the cold state in which the fixation prediction count is less than 3000. The decrease time a is changed to 0.8 s in the state that the fixation prediction count is equal to or greater than 3000 and smaller than 4000. The decrease time a is set to 1.0 s in the state that the fixation prediction count is equal to or greater than 4000.

TABLE 3

| | Decrease time a | Fixation count | Probability of generation of stick-slip sound |
|---|---|---|---|
| Example 2 | None | 1001 | Not generated |
| | 0.8 s | 3000 | Not generated |
| | 1.0 s | 4000 | Not generated |

As in the first embodiment, an excellent result is obtained in the control of the present second embodiment, and the stick-slip sound in the rotation stop period of the fixing motor M is suppressed. In the first embodiment, the stick-slip sound under all of the conditions in which the fixation prediction count is equal to or greater than 3000 needs to be reduced for one type of decrease time a. Therefore, the decrease time needs to be set to a little excessive 1.0 s under the condition in which the fixation prediction count is equal to or greater than 3000 and smaller than 4000. On the other hand, a minimum decrease time can be set according to each fixation prediction count in the present second embodiment. More specifically, the decrease time can be set to 0.8 s under the condition in which the fixation prediction count is equal to or greater than 3000 and smaller than 4000, and the rotation of the fixing apparatus 107 can be stopped in a shorter travel distance. Therefore, it can be stated that the control in the present embodiment that can reduce unnecessary rotation is better in terms of durability of the fixing apparatus 107.

Although three types of low-speed rotation control of the fixing motor M are performed according to the hot condition of the fixing apparatus 107 in the description of the present embodiment, the present embodiment is not limited to this. For example, the hot condition of the fixing apparatus 107 may be divided into more types, and the low-speed rotation control may be changed for each type.

[Another Example of Configuration of Fixing Apparatus]

Although the fixing apparatus of the film heating system described in the first and second embodiments are the fixing apparatus 107 including the thin and flat heater 3 arranged at the fixing nip portion N, the first and second embodiments can also be applied to a fixing apparatus of another film heating system.

Figure 10:
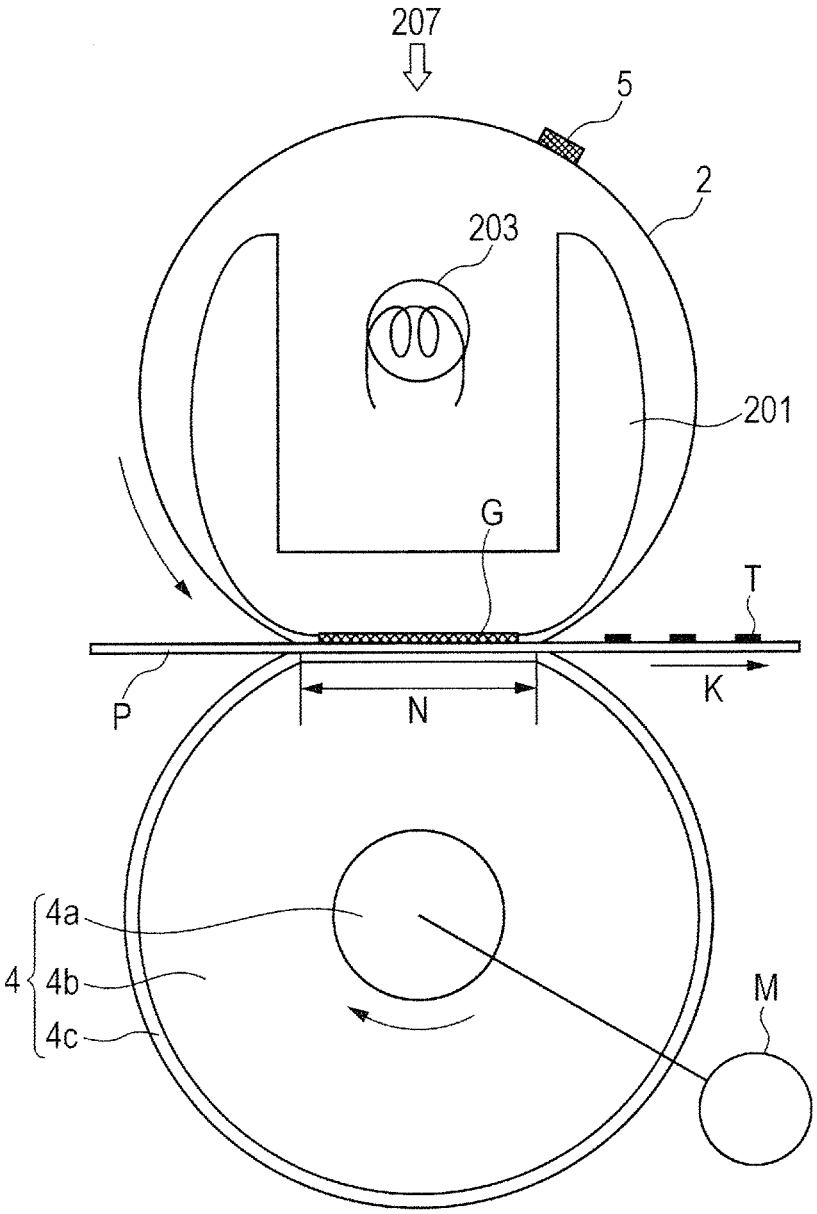
FIG. 10 is a schematic diagram of a fixing apparatus of another film heating system in which the present embodiments can be applied.

FIG. 10 illustrates an example of configuration of a fixing apparatus 207 of another film heating system.

A radiant heat source, such as a halogen heater, is adopted as a heater 203 in the fixing apparatus 207. More specifically, the fixing apparatus 207 includes: the fixing film 2 as a film that is a rotatable flexible member; and a stay 201 as a holding member coming into contact with the inner circumferential surface of the fixing film 2 to hold the fixing film 2 from the inner circumferential surface. The fixing apparatus 207 further includes: the lubricant G applied between the fixing film 2 and the stay 201 to improve the slidability; and the pressure roller 4 as a pressure member configured to rotate while being pressurized and fitted to the fixing film 2 to form the fixing nip portion N. The fixing apparatus 207 further includes: the heater 203 as a heating unit configured to heat at least the fixing nip portion N by energization; and the fixing motor M as a drive unit configured to execute a heating process by rotating and driving the pressure roller 4 and sandwiching and conveying the recording material P carrying the toner image at the fixing nip portion N.

The heater 203 is arranged inside of the fixing film 2 and on an upper part of the stay 201. The heater 203 is configured to heat the fixing film 2 and the stay 201 to heat and fix the toner image T onto the recording material P passing through the fixing nip portion N. The temperature of the fixing film 2 can be set within a desirable range by adjusting the detection result of the temperature detection element 5 arranged on the surface of the fixing film 2 and the amount of current supplied to the heater 203.

Part of the stay 201 is located in the space where the heater 3 is arranged in the first embodiment, and the fixing nip portion N is formed. As in the first embodiment, the lubricant G is used for the slide part of the fixing film 2 and the stay 201, and the stability of the rotation of the fixing film 2 is secured. The other basic configuration is the same as in the first embodiment, and the description will not be repeated.

Even in the fixing apparatus 207 configured this way, the stick-slip sound may be generated in the rotation stop period of the fixing motor M when the fixing apparatus enters the hot state. However, the stick-slip sound in this case is also generated based on the principle described so far, and the control of the first and second embodiments can be performed to reduce the stick-slip sound.

Although the heater 203 is configured to heat the inner circumferential surface of the fixing film 2 in the description, the configuration is not limited to this. The heater 203 can be arranged at an arbitrary location as long as at least the fixing nip portion N is heated.

Although the fixing film 2 is arranged on the unfixed toner image T side on the recording material P in the description of the examples of configuration of the fixing apparatus of FIGS. 1 and 10, the configuration is not limited to this.

The same advantageous effects as in the present invention can be obtained as long as the characteristic components of the film heating system are provided, the components including: a holding member coming into contact with a flexible film inner circumferential surface to hold the film from the inner circumferential surface; and a lubricant applied between the film and the holding member to improve the slidability.

For example, the film may be arranged on the side of the recording material without the toner image.

Although it is desirable to acquire the information related to the warming condition of the apparatus just after the end of the heating process in the first and second embodiments, the information may be acquired before the start of the heating process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-254912, filed Dec. 25, 2015, which is hereby incorporated by reference herein in its entirety.

What is claimed is:

1. A fixing apparatus configured to fix a toner image on a recording material, the apparatus comprising:

a cylindrical heating film;

a nip portion forming member coming into contact with an inner surface of the film, wherein a lubricant is applied to a surface of the nip portion forming member coming into contact with the heating film;

a roller forming a nip portion through the film together with the nip portion forming member, the roller configured to rotate the film by a rotation thereof;

a motor configured to transmit a driving force to the roller to rotate the roller;

a control unit configured to control power supplied to the motor so that a rotational speed of the motor becomes a target rotational speed in a fixing process of conveying and heating the recording material carrying the toner image to fix the toner image to the recording material at the nip portion; and an acquisition unit configured to acquire information related to a warm state of the apparatus, wherein the apparatus is configured to execute the fixing process of conveying and heating the recording material carrying the toner image to fix the toner image to the recording material at the nip portion, wherein the apparatus is configured to stop supply of power to the motor after the end of the fixing process and before starting a subsequent fixing process by executing a first control of stopping the supply of power to the motor and a second control of stopping the supply of power to the motor after an occurrence of a low-speed rotation period in which the motor rotates at a rotational speed lower than the target rotational speed in the fixing process, wherein the apparatus is configured to execute either the first control or the second control to stop supply of power to the motor after the end of the fixing process and before starting the subsequent fixing process based on the acquired information related to the warm state of the apparatus, the acquired information being acquired at the start of the fixing process or after the end of the fixing process, and wherein the apparatus executes the first control in a case where the warm state of the apparatus has not reached a high temperature state and executes the second control in a case where the warm state of the apparatus has reached the high temperature state.

2. The fixing apparatus according to claim 1, wherein the rotational speed of the motor in the low-speed rotation period is set to continuously decrease.

3. The fixing apparatus according to claim 1, wherein the rotational speed of the motor in the low-speed rotation period is set to decrease in stages.

4. The fixing apparatus according to claim 1, wherein the information related to the warm state of the apparatus is information related to a temperature of the roller.

5. The fixing apparatus according to claim 1, further comprising a heater configured to heat the film.

6. The fixing apparatus according to claim 5, wherein power is supplied to the heater in the fixing process, but power is not supplied to the heater in the low-speed rotation period.

7. The fixing apparatus according to claim 1, wherein the nip portion forming member is a heater.

8. The fixing apparatus according to claim 7, further comprising a temperature detection member configured to detect a temperature of the heater, wherein the information related to the warm state of the apparatus is a detection temperature detected by the temperature detection member.

9. The fixing apparatus according to claim 7, wherein power is supplied to the heater in the fixing process, but power is not supplied to the heater in the low-speed rotation period.

10. A fixing apparatus configured to fix a toner image on a recording material, the apparatus comprising:

a cylindrical heating film;

a nip portion forming member coming into contact with an inner surface of the film, wherein a lubricant is applied to a surface of the nip portion forming member coming into contact with the heating film;

a roller forming a nip portion through the film together with the nip portion forming member, the roller configured to rotate the film by a rotation thereof;

a motor configured to transmit a driving force to the roller to rotate the roller;

a control unit configured to control power supplied to the motor so that a rotational speed of the motor becomes a target rotational speed in a fixing process of conveying and heating the recording material carrying the toner image to fix the toner image to the recording material at the nip portion; and an acquisition unit configured to acquire information related to a warm state of the apparatus, wherein the apparatus is configured to execute the fixing process of conveying and heating the recording material carrying the toner image to fix the toner image to the recording material at the nip portion, wherein the apparatus is configured to stop supply of power to the motor after the end of the fixing process and before starting a subsequent fixing process by executing a first control of stopping the motor by setting a rotational speed of the motor to zero and a second control of stopping the motor after an occurrence of a low-speed rotation period in which the motor rotates at a rotational speed lower than the target rotational speed in the fixing process, wherein the apparatus is configured to execute either the first control or the second control to stop the motor after the end of the fixing process and before starting the subsequent fixing process based on the acquired information related to the warm state of the apparatus, the acquired information being acquired at the start of the fixing process or after the end of the fixing process, and wherein the apparatus executes the first control in a case where the warm state of the apparatus has not reached a high temperature state and executes the second control in a case where the warm state of the apparatus has reached the high temperature state.

11. A fixing apparatus configured to fix a toner image on a recording material to the recording material, the apparatus comprising:

a cylindrical heating film;

a nip portion forming member coming into contact with an inner surface of the film, wherein a lubricant is applied to a surface of the nip portion forming member coming into contact with the heating film;

a roller forming a nip portion through the film together with the nip portion forming member, the roller configured to rotate the film by a rotation thereof;

a motor configured to drive the roller;

a control unit configured to control the motor; and an acquisition unit configured to acquire information related to a warm state of the apparatus, wherein the apparatus performs a fixing process to fix the toner image onto the recording material by conveying and heating the recording material at the nip portion, wherein the control unit controls the motor to maintain a target rotational speed during the fixing process, wherein after the end of the fixing process, the control unit is capable of performing a first control to stop the motor not through a low-speed rotation period in which the motor rotates at a rotational speed lower than the target rotational speed in the fixing process, and a second control to stop the motor through the low-speed rotation period, wherein the control unit selects the first control or the second control based on the acquired information related to the warm state of the apparatus, the acquired information being acquired at the start of the fixing process or after the end of the fixing process, and wherein the control unit selects the first control in a case where the warm state of the apparatus has not reached a high temperature state, and selects the second control in a case where the warm state of the apparatus has reached the high temperature state.

12. The fixing apparatus according to claim 11, wherein the rotational speed of the motor in the low-speed rotation period is set to continuously decrease.

13. The fixing apparatus according to claim 11, wherein the rotational speed of the motor in the low-speed rotation period is set to decrease in stages.

14. The fixing apparatus according to claim 11, wherein the information related to the warm state of the apparatus is information related to a temperature of the roller.

15. The fixing apparatus according to claim 11, further comprising a heater configured to heat the film.

16. The fixing apparatus according to claim 15, wherein power is supplied to the heater in the fixing process, but power is not supplied to the heater in the low-speed rotation period.

17. The fixing apparatus according to claim 11, wherein the nip portion forming member is a heater.

18. The fixing apparatus according to claim 17, further comprising a temperature detection member configured to detect a temperature of the heater, wherein the information related to the warm state of the apparatus is a detection temperature detected by the temperature detection member.

19. The fixing apparatus according to claim 17, wherein power is supplied to the heater in the fixing process, but power is not supplied to the heater in the low-speed rotation period.

* * * * *